US006063214A

United States Patent [19]

Fujinaga et al.

[11] Patent Number: 6,063,214

[45] Date of Patent: May 16, 2000

[54] METHOD OF PRODUCING HIGH-STRENGTH STEEL SHEET USED FOR CAN

[75] Inventors: Chikako Fujinaga; Akio Tosaka; Toshiyuki Kato; Kaku Sato; Hideo Kuguminato; Yoshihiro Okawa, all of Chiba, Japan

[73] Assignee: Kawasaki Steel Corporation, Japan

[21] Appl. No.: 08/287,473

[22] Filed: Aug. 8, 1994

Related U.S. Application Data

[63] Continuation of application No. 08/020,057, Feb. 19, 1993, abandoned.

[30] Foreign Application Priority Data

Feb. 21, 1992 [JP] Japan ..... 4-035034

[51] Int. Cl.[7] ..... C21D 8/04

[52] U.S. Cl. ..... 148/602; 148/603

[58] Field of Search ..... 148/601, 602, 148/603

[56] References Cited

U.S. PATENT DOCUMENTS 3,988,173 10/1976 Kawano ..... 148/601

FOREIGN PATENT DOCUMENTS 64-15326 1/1989 Japan .

*Primary Examiner*—Sikyin Ip

*Attorney, Agent, or Firm*—Austin R. Miller

[57] ABSTRACT

A method of producing a steel sheet useful for making cans. The method steps include hot-rolling a slab consisting of about 0.0005 to 0.01 wt % C, about 0.001 to 0.04 wt % N (the total of C and N is at least about 0.008 wt %), about 0.05 to 2.0 wt % Mn, about 0.005 wt % or less Al, about 0.01 wt % or less O at a finish rolling temperature within a temperature range of about the $Ar_3$ point to about 950° C., coiling the rolled material at a temperature range of about 400 to 600° C., cold rolling the material, continuously annealing the material at a temperature higher than the recrystallization temperature, and then temper-rolling the material. The steel sheet exhibits good workability during can making and which can be formed into a can having high strength.

6 Claims, 1 Drawing Sheet

METHOD OF PRODUCING HIGH-STRENGTH STEEL SHEET USED FOR CAN

This application is a continuation of application Ser. No. 08/020,057, filed Feb. 19, 1993, now abandoned.

BACKGROUND OF THE INVENTION

1. Field of the Invention

The present invention relates to a method of producing a high-strength steel sheet which exhibits good workability and which can be formed into a can having high strength by drawing with minimized earing.

According to JIS G 3303, the temper degrees of black plate used for can making are classified in classes T-1 to T-6 in order of softness. A target value of Rockwell hardness (HR 30T) is determined for each of the temper degrees. Sheet materials having a temper degree of T-3 or less are referred to as "soft materials", and sheet materials having a temper degree of T-4 to T-6 are referred to as "hard materials".

Soft steels having a temper degree of T-1 or T-2 are generally used as materials for making two-piece cans such as drawn and ironed cans, drawn and redrawn cans, drawn and thin redrawn cans and the like, because of their property of deep drawability. In recent years, however, the steel has more often been thinned in order to decrease the cost of the can. Since the strength of a steel sheet must thus be increased to compensate for the thickness decrease, hard steels having a temper degree of T-4 to T-6, which is higher than that of conventional can materials, are more often used. Higher strength is also required for three-piece cans as thinning of cans progresses. These are generally produced from a material having a temper degree of about T-4 to T-5.

Particularly when two-piece cans are produced, if significant earing is encountered during drawing, the yield of product deteriorates, and difficulties such as breakage of earing and the like occur during can making, thereby decreasing production efficiency. For this reason, a steel sheet is required which encounters reduced earing during drawing. In addition, when the height of a can is achieved by drawing, as in drawn and redrawn (DRD) cans and drawn and thinned redrawn (DTR) cans, good drawability is also required of the steel.

However, although many conventional steels have high strength they exhibit poor drawability and undergo excessive earing during can making. There is accordingly a serious demand for improving the characteristics of these can-making materials.

2. Description of the Related Art

Examples of methods of producing black plate of a hard material having good workability and a temper degree of T-4 to T-6 include the methods disclosed in Japanese Patent Laid-Open Nos. 58-27931 and 2-118027.

Japanese Patent Laid-Open No. 58-27931 relates to a method of producing a base steel sheet for tin or tin-free steel sheet. This method comprises hot rolling low-carbon aluminum killed steel containing 0.01 to 0.04 wt % carbon, pickling, cold rolling, annealing, and temper rolling. However, it is difficult by this method to obtain a steel sheet which satisfies the level of workability required for thin material for forming into two-piece cans.

Japanese Patent Laid-Open No.2-118027 discloses a method of producing a steel sheet for making cans. This method comprises hot rolling a continuously cast slab consisting of 0.004 wt % or less carbon, 0.05 to 0.2 wt % aluminum, 0.003 wt % or less nitrogen and 0.01 wt % or less niobium, cold rolling the resulting material at a reduction of 85 to 90%, continuously annealing the material and temper-rolling the material at a reduction of 15 to 45%. The steel sheet obtained by this method exhibits excellent deep drawability, and encounters reduced earing during drawing. However, the method presents a problem with respect to the low level of work hardening during can making, which is due to a small amount of strain aging.

In order to secure the strength of the body of a two-piece can such as a DI can, a DRD can, a DTR can or the like, work hardening comprising drawing, ironing and the like is employed during can making. The use of steel sheets obtained by the above methods and exhibiting less strain aging thus prevents the production of a can having a body with sufficiently high strength.

SUMMARY OF THE INVENTION

An object of the present invention is to provide a steel sheet for making cans which permits an increase of strength despite a decrease of thickness of a two-piece or three-piece can, which overcomes the problems associated with conventional methods, and which can produce a steel sheet having good workability and strength and capable of being formed into cans of various types, particularly two-piece cans.

In accordance with one aspect of the present invention, the method comprises hot-rolling a slab at a finish rolling temperature which ranges from about the $Ar_3$ transformation point of the metal to about 950° C., coiling the rolled material at a temperature within the range from about 400° C. to 600° C., cold-rolling the material after pickling, continuously annealing the material at a temperature higher than the recrystallization temperature, and then temper-rolling the material at a reduction of about 5% or more. The slab used consists of about 0.0005 to 0.01 wt % C, about 0.001 to 0.04 wt % N (the total amount of C and N is at least 0.008 wt %), about 0.05 to 2.0 wt % Mn, about 0.005 wt % or less Al, about 0.01 wt % or less O, and the balance comprising iron and incidental impurities.

The slab may advantageously contain at least one other metallic constituent, including about 0.001 wt % to 0.01 wt % Ti, about 0.001 to 0.01 wt % Nb, and about 0.0001 to 0.001 wt % B or any combinations thereof.

In accordance with another aspect of the present invention, the method previously described may be performed on a similar slab which also contains about 0.03 to 0.15 wt % P.

The slab may further contain at least one additional metallic constituent comprising about 0.001 wt % to 0.01 wt % Ti, about 0.001 to 0.01 wt % Nb, and about 0.0001 to 0.001 wt % B, or any combination thereof.

Other features and variations of the present invention are made clear by the detailed description below, which is intended to illustrate specific embodiments and not to limit the scope of the invention, which is defined in the appended claims.

DETAILED DESCRIPTION OF THE EMBODIMENTS

Figure 1:
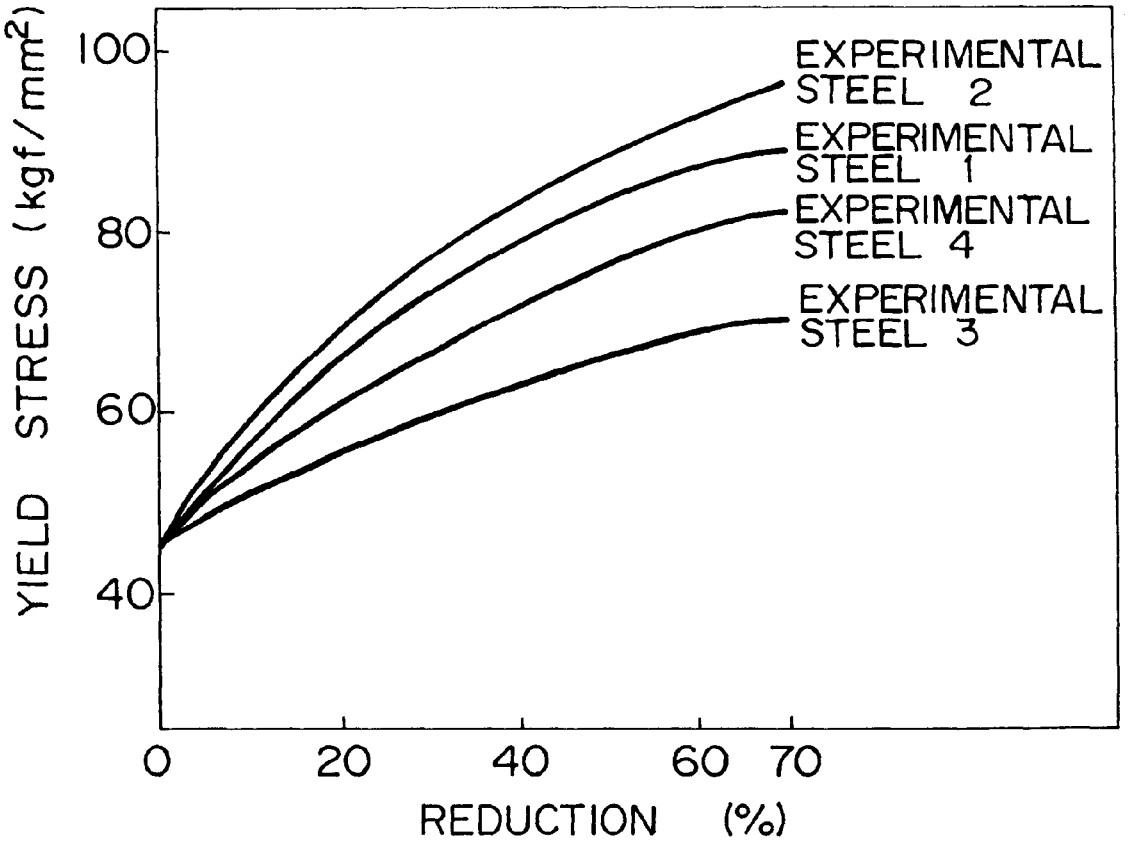
FIG. 1 is a graph showing relationships between reduction and yield stress when a strain is applied by rolling to various steels.

As an illustration of specific examples of this invention, several experimental examples which resulted in the achievement of the present invention will now be described and compared with comparative examples that are outside the scope of the invention.

A slab consisting of 0.005 wt % C, 0.006 wt % N (C+N=0.011 wt %), 0.3 wt % Mn, 0.002 wt % Al, 0.01 wt % P (in this case, an incidental component), and 0.004 wt % O, was prepared. We also prepared another slab consisting of 0.005 wt % C, 0.005 wt % N (C+N=0.010 wt %), 0.2 wt % Mn, 0.002 wt % Al, 0.08 wt % P and 0.004 wt % O. Each of these slabs was hot-rolled at a finish rolling temperature of 880° C. and was then coiled at a temperature of 520° C. After cold-rolling and continuous annealing, the former and latter slabs were subjected to temper rolling at a reduction of 8% and 1%, respectively, to produce steel sheets (Experimental Steel Samples 1 and 2, respectively), having a temper degree of T-4.

On the other hand, an ultra low-carbon slab consisting of 0.002 wt % C, 0.002 wt % N (C+N=0.004 wt %), 0.3 wt % Mn, 0.05 wt % Al, 0.004 wt % O, and 0.003 wt % Nb was hot-rolled in a conventional manner, cold-rolled at a reduction of 88%, continuously annealed and then temper-rolled at a reduction of 20% to produce a steel sheet (Experimental Steel Sample 3) having a temper degree of T-4.

Another low-carbon slab consisting of 0.03 wt % C, 0.003 wt % N (C+N=0.033 wt %), 0.2 wt % Mn, 0.05 wt % Al, and 0.004 wt % O was used as a comparative slab. It was then hot-rolled in a conventional manner, cold-rolled, continuously annealed and then temper-rolled at a reduction of 1% to produce a steel sheet (Experimental Steel Sample 4) having a temper degree of T-4.

After each of the experimental steel sheets (Experimental Steel Samples 1 to 4) was subjected to aging (at 210° C. for 20 min.) corresponding to coating and baking during can making, the strength and workability of the products were evaluated.

Workability during usual drawing was evaluated based on the Lankford value (r value); a high average r value shows excellent deep drawability. The amount of earing produced was evaluated on the basis of the planar anisotropy of the r value (Δr value); a Δr value close to zero shows a small amount of earing and excellent workability, particularly, when the steel sheet is used for making two-piece cans.

The workability of each of the steel sheets during can making was than evaluated by measuring the average r value and the Δr value (in the present invention, the absolute value of Δr is shown).

The results of measurement are shown in Table 1 which follows:

TABLE 1

| Experimental Sample No. | Mean r Value | Δr Value |
|---|---|---|
| 1 | 1.6 | 0.1 |
| 2 | 1.6 | 0.1 |
| 3 | 1.6 | 0.1 |
| 4 | 1.1 | 0.7 |

As is shown by Table 1, each of Experimental Steel Samples 1 and 2 showed a high average r value and a low Δr value and exhibited workability much better than that of Experimental Steel Sample 4, which was formed from a low-carbon steel generally used as a hard material. Their characteristics were equivalent to those of Experimental Steel Sample 3, which was formed by using an ultra low-carbon steel which is generally considered to have excellent workability when used for making cans. It was thus apparent that Experimental Steel Samples 1 and 2 had excellent workability when used to make steel sheets for cans.

Further, the yield stress of each of the samples was measured by tensile tests after strain was applied by rolling. This was done in order to evaluate the strength of the two-piece can formed by using the sheet produced in each sample.

Of the present two-piece cans, the body of a DI can is subjected to working to the greatest extent during can making; a rolling simulation shows a working reduction of about 70%. The extent of working during formation of two-piece cans such as DTR and DRD cans, other than DI cans, is smaller than that of DI cans. The strength characteristics of the various two-piece cans formed can thus be evaluated by measuring the strength changes caused by working at a reduction of 70% or less.

FIG. 1 shows the relation between the reduction and the yield stress of the steel sheets obtained by rolling the steel sheet of each experimental sheet sample produced with a temper degree of T-4.

As seen from FIG. 1, the increase of yield stress of each of Experimental Steel Samples 1 and 2, which was caused by working, was greater than that of Experimental Steel Sample 4 using low-carbon steel which is generally used as a hard material. This shows that the strength of the can formed was clearly increased. It is thus apparent that Experimental Steel Samples 1 and 2 were very useful for thinning sheets for use in cans.

Like the DI cans, two-piece cans are generally subjected to coating and baking before or after forming. After temper rolling, each of the Experimental Steel Samples was thus subjected to rolling (reduction 70%) corresponding to the amount of working for forming DI cans without aging treatment, and then subjecting to aging treatment corresponding to coating and baking. At the same time, the yield strength of each of the samples was measured. As a result, the yield strength measured was the same as that obtained when the material was subjected to aging treatment before rolling.

The above results also reveal that each of Experimental Steel Samples 1 and 2 of the present invention has its strength easily increased by temper rolling, as compared with Experimental Steel Samples 3 and 4 of comparative steel, and that Experimental Steel Samples 1 and 2 were useful for obtaining high-strength steel sheets for thinning of three-piece cans, Possible bases of these results are the facts that the C and N contents in the solid solution were high, that the steel was highly pure (containing small amounts of carbide and nitride), and that the crystal grain size was relatively large.

A description will now be made of the reasons for providing limits in defining the scope of the present invention.

(Chemical Composition)

C: about 0.0005 to 0.01 wt %

C is an important component in the present invention. The presence of C in solid solution in steel increases the strength of the steel, particularly, increases the yield strength of a can formed of the sheet due to the application of working strain. However, if the C content exceeds about 0.01 wt % it tends to precipitate as cementite or the like; thus an increase of strength of the resulting can cannot be expected. Further, the presence of the precipitate in a hot-rolled steel sheet decreases the average r value after cold rolling and annealing. Moreover, when N content is abundant, C content may be lowered with a present steelmaking technology to an economically allowable limit as low as to 0.0005 wt %. Therefore, the content of C is within the range of about 0.0005 wt % and 0.01 wt %.

N: about 0.001 to 0.04 wt %

Similarly, the presence of N in a solid solution state in steel increases the steel strength of the can formed. However, if the N content exceeds about 0.04 wt %, a precipitate of iron nitride or the like is formed in the steel, and does not contribute to further increase of strength, and also deteriorates workability. Moreover, when C content is abundant, N content may be lowered with a present steel-making technology to an economically allowable limit as low as to 0.001 wt %. Therefore, the content of N is within the range of about 0.001 wt % and 0.04 wt %.

C+N: about 0.008 wt % or more

C and N are important for increasing the strength of the can formed, as compared to conventional cans. The presence of C and N as components in a solid solution increases deformation resistance due to strain aging when a strain is applied to the steel. Namely, the presence of both C and N components can further increase the strength of the sheet due to working. In accordance with the present invention the ranges of these components are limited and the production conditions are controlled so that components C and N are mainly present in a solid solution state. The increase of strength, which is caused by working, can thus be evaluated based on the total content of C and N. When the total content of C and N is about 0.008 wt % or more, strength after working can achieve a value higher than that attained from conventional materials. Particularly, keeping in mind that the steel of the present invention usually contains a small amount of Al, AlN does not precipitate, and strain aging is thus easily produced by N. It is thus preferable that the N content is at least half of about 0.008 wt % which is the lower limit of the total content of C and N, i.e., at least about 0.004 wt %.

Mn: about 0.05 to 2.0 wt %

Mn is effective for improving the strength of the steel and is required for preventing hot brittleness due to the presence of S. It is necessary for obtaining the above effects that the Mn content is at least about 0.05 wt %. However, if a large amount of Mn is added, the hot-rolled steel sheet is hardened and cold-rolling becomes very difficult. Thus the upper limit of the Mn content is about 2 wt %, and the Mn content is within the range from about 0.05 wt % to 2.0 wt %.

Al: about 0.005 wt % or less

Al is a very important component in the present invention. In usual aluminum killed steel, since a large amount of Al is added for sufficiently decreasing the oxygen content, at least about 0.02 wt % of soluble Al is present in the steel. In particular, when a steel sheet required to have sufficient workability is produced, the content of soluble Al is generally at least about 0.04 wt %, and the component N in the steel is sufficiently precipitated by coiling the steel sheet at a high temperature after hot-rolling.

Similarly, in the present invention, deoxidization by Al is required for decreasing the oxygen content in steel because oxygen cannot be sufficiently removed by providing only vacuum degassing during formation of the steel. In the practice of the present invention, however, since N is present as a solid solution in the steel and serves to increase the strength of the steel sheet, and the presence of soluble Al tends to slow down the increase of strength of the can formed, as described above, the content of soluble Al in the steel must be kept as low as possible. The presence of insoluble Al, i.e., aluminum oxide, in steel causes problems such as tendency toward breakage during formation of the can. For the above reasons, the contents of both soluble and insoluble Al in steel must be decreased, and the allowable upper limit of the total Al content is about 0.005 wt %.

O: about 0.01 wt % or less

O is hardly present in a solid solution state in steel, and is present in the form of an oxide. Particularly, when O is present in the form of aluminum oxide, the oxide has adverse effects such as breakage during formation of a can and the like, as described above. In the practice of the present invention, however, the amount of aluminum used in the step of producing steel is limited, and the aluminum oxide is separated as much as possible by floating in the process of producing steel. Although the content of aluminum oxide (which is a serious problem) is thus significantly decreased, if large amounts of oxides other than aluminum oxide are present, the workability and corrosion resistance of steel significantly deteriorate. The O content is thus kept as low as possible, and the upper limit of the O content is about 0.01 wt %. Particularly, when the workability of a flange portion of a can is a problem, e.g., when DI cans, DTR cans or the like are being produced, the O content of the steel is preferably about 0.006 wt % or less.

P: about 0.030 to 0.15 wt %

P is a component effective for increasing the strength of steel and decreasing the reduction of the temper rolling of the steel. Although P has a substantial strengthening effect, the P content in a conventional steel sheet for making cans is held down to a low value of about 0.01 wt % in order to prevent deterioration of corrosion resistance. However, in the present invention, the amounts of precipitates such as carbide, nitride, oxide or the like in the steel, which adversely affect its corrosion resistance, are decreased as much as possible by controlling the contents of C, N, Al, O and the like, thereby producing a clean steel. The steel material of the present invention thus has higher corrosion resistance than that of conventional materials, and the corrosion resistance is not affected by adding P to some extent. The P content is thus at least about 0.03 wt % which has the effect of increasing the strength, and the upper limit is about 0.15 wt % which does not cause deteriorating workability.

Ti, Nb: about 0.001 to 0.01 wt %, B: about 0.0001 to 0.001 wt %

As described above, in the present invention, the growth properties of crystal grains are improved by significantly decreasing the Al content to a value lower than that of conventional Al killed steel. The grain size of the steel sheet is thus significantly affected by the soaking temperature during continuous annealing, and is easily affected by a change in the soaking temperature during passage of the sheet, thereby causing a variation in strength. In order to decrease this effect, selected amounts of any of Ti, Nb or B or combinations thereof may be added for controlling grain growing properties.

The addition of Ti, Nb or B or any combinations thereof decreases the effect of variations of soaking temperature on the grain size, improves workability and advantageously increases hardness due to decrease of size of the crystal grains after recrystallization. It is effective for exhibiting the effects to include at least about 0.001 wt % of Ti or Nb, or at least about 0.0001 wt % of B. However, if the content of Ti or Nb exceeds about 0.01 wt %, or the content of B exceeds about 0.001 wt %, a carbonitride or a nitride, respectively, may be formed, and the contents of C and N in the steel are undesirably decreased. Thus the content of Ti or Nb is held within the range of about 0.001 wt % to 0.01 wt %, and the content of B is within the range of about 0.0001 wt % and 0.001 wt %.

Production Conditions

Production of steel

The melting method and degassing conditions are not limited, and the steel may be produced by any usual method while paying attention to the control of the amount of Al added and the decrease of the O content.

Although the slab is preferably produced by continuous casting, the slab producing method is not specifically limited.

Hot-rolling

With a finish rolling temperature lower than the $Ar_3$ transformation temperature, the grain size of the hot-rolled steel sheet is increased, and the crystal grain size of the steel sheet after cold rolling and recrystallization annealing is also increased, thereby decreasing the strength of the steel. The finish rolling temperature is thus higher than the $Ar_3$ transformation temperature. On the other hand, if the finish rolling temperature is excessively high, the crystal grain size of the hot-rolled steel sheet is increased. The upper limit of the finish rolling temperature is thus about 950° C.

Coiling temperature

If the coiling temperature after hot-rolling is too high, C in the hot-rolled steel sheet easily precipitates, and the crystal grain size is increased. The upper limit of the coiling temperature is thus about 600° C. When Ti, Nb, B or P are not added the crystal grain growing property is improved and the crystal grain size of the hot-rolled steel sheet increases as the coiling temperature increases. Particularly, it is preferable for decreasing the crystal grain size to coil the sheet at a low temperature of about 530° C. or less. On the other hand, if the coiling temperature is excessively low the hot-rolled steel sheet is hardened and cold rolling cannot be sufficiently performed. The lower limit of the coiling temperature is thus about 400° C.

Cold rolling

The steel sheet hot-rolled by the above method may be pickled and then cold-rolled by any usual method.

Annealing (recrystallization annealing)

The cold-rolled steel sheet is annealed by continuous annealing which hardly produces C precipitates, which causes the formation of products with good uniformity and which exhibits good productivity. The annealing temperature may be the recrystallization temperature or above. After annealing, cooling is preferably performed at high speed for securing strength. In particular, it is preferable to cool the steel sheet at a speed of about 10° C./s or more within the temperature range of the annealing temperature to about 300° C., which easily produces C precipitates.

Temper rolling

The steel sheet annealed is subjected to temper rolling with an appropriate reduction in order to obtain the intended hardness. When P is not added as a strengthening component, the reduction is at least about 5% in order to obtain a hard material having a temper degree of T-4 to T-6. When P is added intentionally (in the present invention, about 0.03% or more), the reduction may be as low as about 1% because the material itself has sufficiently high strength. However, the reduction may be increased for obtaining a harder material.

Temper rolling is also effective for decreasing stretcher strain. A steel sheet exhibiting a very low degree of yield elongation can be obtained by increasing the reduction even after aging treatment such as coating and baking or the like before working. If the reduction exceeds about 50%, the productivity of the present producing apparatus significantly deteriorates. It is thus preferable that the reduction is about 50% or less.

EXAMPLES

Continuously cast slabs were made by melting steel with a degassing treatment in a converter. Having each of the chemical compositions shown in Table 2 each was successively subjected to hot rolling, pickling, cold rolling, continuous annealing and temper rolling under the conditions shown in Table 3 to produce steel sheets having a thickness of 0.3 mm. The hardness (HR 30T), the average r and the Δr value each of the steel sheets were measured. Each of the sheets was then finished to form a #25 tinned steel sheet and then formed into a 350-ml DI can. A sample was obtained from the body of each of the cans after coating and baking and was measured for tensile strength. The results of the material tests are summarized in Table 3, which follows Table 2, the same sample numbers being used for the same samples in both Tables 2 and 3.

TABLE 2

| | Chemical Composition (wt %) | | | | | | | | | |
|---|---|---|---|---|---|---|---|---|---|---|
| Sample No. | C | Mn | P | Total Al | N | O | Ti | Nb | B | Remarks |
| 1 | 0.005 | 0.5 | 0.01 | 0.002 | 0.006 | 0.004 | 0 | 0 | 0 | Examples of the Invention |
| 2 | 0.005 | 0.5 | 0.01 | 0.002 | 0.006 | 0.004 | 0 | 0 | 0 | |
| 3 | 0.007 | 0.2 | 0.01 | 0.002 | 0.009 | 0.003 | 0 | 0 | 0 | |
| 4 | 0.005 | 0.3 | 0.01 | 0.002 | 0.006 | 0.004 | 0 | 0 | 0 | |
| 5 | 0.005 | 0.3 | 0.01 | 0.002 | 0.006 | 0.004 | 0 | 0 | 0 | |
| 6 | 0.005 | 0.4 | 0.01 | 0.001 | 0.007 | 0.004 | 0 | 0 | 0.0003 | |
| 7 | 0.005 | 0.4 | 0.01 | 0.001 | 0.007 | 0.004 | 0 | 0 | 0.0003 | |
| 8 | 0.006 | 0.3 | 0.01 | 0.002 | 0.007 | 0.005 | 0 | 0.004 | 0 | |
| 9 | 0.006 | 0.3 | 0.01 | 0.002 | 0.007 | 0.005 | 0 | 0.004 | 0 | |
| 10 | 0.005 | 0.2 | 0.01 | 0.002 | 0.006 | 0.006 | 0.005 | 0 | 0 | |
| 11 | 0.005 | 0.2 | 0.01 | 0.002 | 0.007 | 0.004 | 0 | 0.003 | 0.0003 | |
| 12 | 0.003 | 0.7 | 0.01 | 0.002 | 0.012 | 0.004 | 0.004 | 0.004 | 0.0003 | |
| 13 | 0.005 | 0.2 | 0.08 | 0.002 | 0.005 | 0.005 | 0 | 0 | 0 | |
| 14 | 0.005 | 0.2 | 0.04 | 0.002 | 0.005 | 0.005 | 0 | 0 | 0 | |
| 15 | 0.004 | 0.3 | 0.07 | 0.001 | 0.009 | 0.004 | 0 | 0 | 0.0002 | |
| 16 | 0.006 | 0.5 | 0.08 | 0.002 | 0.007 | 0.004 | 0 | 0.003 | 0 | |
| 17 | 0.005 | 0.3 | 0.13 | 0.001 | 0.005 | 0.005 | 0.004 | 0 | 0.0005 | |
| 18 | 0.004 | 0.1 | 0.05 | 0.002 | 0.004 | 0.004 | 0 | 0.005 | 0.0002 | |
| 19 | 0.004 | 0.2 | 0.08 | 0.002 | 0.007 | 0.004 | 0.003 | 0.003 | 0.0003 | |
| 20 | 0.005 | 1.2 | 0.01 | 0.002 | 0.007 | 0.003 | 0 | 0.005 | 0 | |

TABLE 2-continued

| Sample No. | Chemical Composition (wt %) C | Mn | P | Total Al | N | O | Ti | Nb | B | Remarks |
|---|---|---|---|---|---|---|---|---|---|---|
| 21 | 0.005 | 1.0 | 0.01 | 0.003 | 0.012 | 0.004 | 0 | 0.004 | 0 | |
| 22 | 0.002 | 0.3 | 0.01 | 0.04 | 0.002 | 0.004 | 0 | 0.004 | 0 | Comparative |
| 23 | 0.03 | 0.3 | 0.01 | 0.04 | 0.002 | 0.005 | 0 | 0 | 0 | Examples |

TABLE 3(1)

| Sample No. | Hot-rolling Finishing Temp. (° C.) | Coiling Temp. (° C.) | Continuous Annealing Condition | Skin-pass Rolling Reduction (%) | Hardness (HR 30T) | Mean r Value | Δr Value | Yield Strength of Produced Can (kgf/mm$^2$) | Remarks |
|---|---|---|---|---|---|---|---|---|---|
| 1 | 890 | 520 | 700° × 20 sec | 15 | 69 | 1.5 | 0.1 | 94 | Examples |
| 2 | 880 | 500 | 700° × 20 sec | 20 | 73 | 1.5 | 0.15 | 94 | of the |
| 3 | 900 | 520 | 670° × 10 sec | 8 | 62 | 1.5 | 0.2 | 95 | Invention |
| 4 | 880 | 520 | 700° × 20 sec | 12 | 64 | 1.5 | 0.1 | 95 | |
| 5 | 880 | 520 | 750° × 20 sec | 12 | 61 | 1.6 | 0.1 | 95 | |
| 6 | 880 | 530 | 700° × 20 sec | 12 | 65 | 1.8 | 0.05 | 95 | |
| 7 | 880 | 530 | 750° × 20 sec | 12 | 64 | 1.8 | 0.1 | 95 | |
| 8 | 880 | 530 | 720° × 20 sec | 12 | 65 | 1.9 | 0.1 | 94 | |
| 9 | 890 | 530 | 770° × 20 sec | 12 | 64 | 1.9 | 0.05 | 95 | |
| 10 | 880 | 580 | 760° × 10 sec | 12 | 65 | 1.8 | 0.1 | 95 | |
| 11 | 880 | 540 | 750° × 20 sec | 12 | 65 | 1.9 | 0.05 | 95 | |
| 12 | 880 | 520 | 760° × 20 sec | 12 | 67 | 1.8 | 0.15 | 95 | |
| 13 | 880 | 580 | 700° × 10 sec | 2 | 64 | 1.5 | 0.1 | 101 | |
| 14 | 880 | 550 | 700° × 10 sec | 10 | 70 | 1.5 | 0.1 | 97 | |

TABLE 3(2)

| Sample No. | Hot-rolling Finishing Temp. (° C.) | Coiling Temp. (° C.) | Continuous Annealing Condition | Skin-pass Rolling Reduction (%) | Hardness (HR 30T) | Mean r Value | Δr Value | Yield Strength of Produced Can (kgf/mm$^2$) | Remarks |
|---|---|---|---|---|---|---|---|---|---|
| 15 | 880 | 530 | 700° × 10 sec | 5 | 68 | 1.8 | 0.1 | 101 | Examples of |
| 16 | 880 | 550 | 700° × 10 sec | 15 | 75 | 1.9 | 0.1 | 103 | the |
| 17 | 880 | 520 | 750° × 20 sec | 8 | 70 | 1.6 | 0.2 | 104 | Invention |
| 18 | 880 | 550 | 700° × 20 sec | 3 | 60 | 1.8 | 0.1 | 98 | |
| 19 | 880 | 520 | 750° × 10 sec | 5 | 68 | 1.7 | 0.1 | 99 | |
| 20 | 890 | 520 | 700° × 20 sec | 13 | 70 | 1.5 | 0.1 | 96 | |
| 21 | 890 | 500 | 700° × 20 sec | 10 | 70 | 1.5 | 0.1 | 100 | |
| 22 | 880 | 600 | 700° × 20 sec | 25 | 65 | 1.5 | 0.1 | 70 | Comparative |
| 23 | 880 | 600 | 680° × 20 sec | 1 | 60 | 1.1 | 0.6 | 89 | Examples |

As is shown by the actual results, any one of Sample Nos. 1 to 21 shows a large average r and a small Δr value. Samples Nos. 1 to 21 also show good workability and small amounts of earing produced during forming of cans (DI cans), and further show can strengths higher than Sample No. 23 which is a comparative example based upon the use of a low-carbon steel.

On the other hand, Comparative Sample No. 23 shows can strength which is lower than that of the examples of the present invention. This sample also showed poor workability and substantial earing during can making. Although Comparative Sample No. 22 had good workability and small amounts of earing during can making, it possessed clearly insufficient can strength. Samples Nos. 1, 8, 13, 16, 22 and 23 were continuously annealed under the conditions shown in Table 3, and were subjected to temper rolling at a reduction of 30%, tinning, coating and baking and were then formed into a three-piece can. A sample was obtained from the body of each of the cans and was examined with respect to yield strength. As a result, the values of yield strength of Samples Nos. 1, 8, 13, 16, 22 and 23 were 70, 72, 78, 80, 52 and 65 kgf/mm$^2$, respectively. The can strengths of the steels of the present invention (Samples Nos. 1, 8, 13 and 16) are higher than the comparative steels (Samples Nos. 22 and 23).

In addition, the steel of the present invention causes no problem with respect to surface properties or corrosion resistance, which are problems when used as a steel sheet used for can.

Although, in the above examples, a tinned steel sheet was finished to a DI can or a three-piece can, the steel sheet obtained in the present invention can be used as a tin-free steel sheet, a composite plated steel sheet, a steel sheet subjected to coat printing before working, a steel sheet laminated with an organic resin film or other forms of sheet steel. The steel sheet can also advantageously be applied to various two-piece cans and three-piece cans such as DTR cans, DRD cans and the like, other than DI cans.

The present invention effectively employs C and N in a solid solution state so as to provide a hard thin steel sheet which permits achievement of strength increase corresponding to a reduction in thickness of a two-piece can or three-piece can and which exhibits good workability during can making. In addition, the reduction of temper rolling after annealing by the continuous annealing method is controlled during the producing process so that a hard material having strength corresponding to any desired degree of thinning can be obtained from the same material. The present invention can thus improve the productivity and economy of producing steel sheet and has remarkable effects in actual production and use.

What is claimed is:

1. A method of producing a high-strength steel sheet having excellent workability used for can making comprising:

hot rolling a slab at a temperature within the range of about the $Ar_3$ transformation temperature to about 950° C. to provide a rolled steel strip;

coiling the rolled steel strip at a temperature range of about 400° C. to 600° C. to provide a hot-rolled steel strip;

pickling and cold rolling the hot-rolled steel strip to provide a cold-rolled steel strip;

continuously annealing the cold-rolled steel strip at a temperature higher than its recrystallization temperature;

and then temper rolling the annealed cold-rolled steel strip at a reduction of about 5% or more;

wherein said slab comprises:

C: about 0.0005 to 0.01 wt %,

N: about 0.001 to 0.04 wt %, the total amount of C and N being about 0.008 wt % or more and at least a majority of the components C and N being present as a solid solution, Mn: about 0.05 wt % to 2.0 wt %, Al: about 0.005 wt % or less, O: about 0.01 wt % or less, and the balance consisting of Fe and impurities.

2. A method of producing a high-strength steel sheet having excellent workability used for can according to claim 1, wherein said slab further contains at least one member selected from the group consisting of:

Ti: about 0.001 wt % to 0.01 wt %,

Nb: about 0.001 wt % to less than 0.01 wt %, and

B: about 0.0001 wt % to 0.001 wt %.

3. A method of producing a high-strength steel sheet having excellent workability used for can according to claim 1, wherein said temper rolling is performed at a reduction of about 50% or less.

4. A method of producing a high-strength steel sheet having excellent workability used for can making, said steel containing phosphorus and having increased strength and decreased reduction characteristics, comprising:

hot rolling a slab having a composition as defined hereinafter at a temperature within the range of about the $Ar_3$ transformation temperature of the steel to about 950° C. to provide a rolled steel strip;

coiling the rolled steel strip at a temperature in the range of about 400° C. to 600° C. to provide a hot-rolled steel strip;

pickling and cold rolling the hot-rolled steel strip by any usual method to provide a cold-rolled steel strip;

continuously annealing the cold-rolled steel strip at a temperature higher than its recrystallization temperature;

and then temper rolling the annealed cold-rolled steel strip;

wherein said slab comprises:

C: about 0.0005 to 0.01 wt %,

N: about 0.001 to 0.04 wt %, the total amount of C and N being about 0.008 wt % or more and at least a majority of the components C and N being present as a solid solution, Mn: about 0.05 wt % to 2.0 wt %, P: about 0.03 wt % to 0.15 wt %, Al: about 0.005 wt % or less, O: about 0.01 wt % or less, and the balance consisting of Fe and impurities.

5. A method of producing a high-strength steel sheet having excellent workability used for can according to claim 4, wherein said slab further contains at least one member selected from the group consisting of:

Ti: about 0.001 wt % to 0.01 wt %,

Nb: about 0.001 wt % to less than 0.01 wt %, and

B: about 0.0001 wt % to 0.001 wt %.

6. A method of producing a high-strength steel sheet having excellent workability used for can according to claim 4, wherein temper rolling is performed at a reduction of about 1.0% to 50%.

* * * * *